United States Patent [19]

Grady, II

[11] 4,357,784

[45] Nov. 9, 1982

[54] STRUCTURAL UNITS AND ARRAYS THEREFROM

[76] Inventor: Clyde C. Grady, II, 889 Azalea St., Apartment 11, Baton Rouge, La. 70802

[21] Appl. No.: 35,597

[22] Filed: May 3, 1979

Related U.S. Application Data

[63] Continuation of Ser. No. 828,312, Aug. 29, 1977, Pat. No. 4,324,037.

[51] Int. Cl.[3] ..... E04C 1/10

[52] U.S. Cl. ..... 52/585; 29/452; 29/526 R; 52/227

[58] Field of Search ..... 29/433, 452, 469, 526, 29/527.1, 530; 52/227, 228, 229, 585, 587; 249/38, 84, 168, 169, 188, 189; 264/271, 274, 279

[56] References Cited

U.S. PATENT DOCUMENTS

| | | | |
|---|---|---|---|
| 2,751,776 | 6/1956 | Streblow et al. | 52/228 |
| 2,902,721 | 9/1959 | Heuer | 264/274 |
| 3,295,286 | 1/1967 | Schaich | 52/585 |

*Primary Examiner*—Leon Gilden

[57] ABSTRACT

A building structural unit and its method of construction is disclosed. Additionally provided is a method for the building of structural arrays with a plurality of the structural units. The structural unit of the present invention provides an inner structural core portion having provided attached to the outer surface thereof load-distributing surfaces. Suitable attachment means can be provided in order to facilitate connection of a plurality of the individual units together forming a structural array such as a wall, slab, ceiling, column, or the like. The structural units can be fastened together by means of tension members such as for example threaded rods, with each individual unit being provided with bores therethrough through which the tension members or rods can pass. Bolted or like connections at the tension member ends bear upon the provided load distributing surface to complete the desired mating of the individual units. A method for connecting the units together in order to form the desired structural array allows each unit to be completely self supported structurally upon its connection to the previous unit or to the formed array itself. A first embodiment provides a substantially rectangular shaped structural unit, useful in wall construction (FIGS. 2 and 3); a second embodiment provides a diagonally interfacing unit, useful in the construction of slabs, ceilings and the like (FIGS. 4 and 5); a third embodiment also provides an alternative diagonally interfacing unit useful in slab and ceiling construction, a fourth embodiment provides a unit member suitable for column construction; in a fifth embodiment, a generally hexagonal unit structure is disclosed.

9 Claims, 13 Drawing Figures

8

STRUCTURAL UNITS AND ARRAYS THEREFROM

This is a continuation, of application Ser. No. 828,312, filed Aug. 29, 1977, now U.S. Pat. No. 4,324,037.

BACKGROUND OF THE INVENTION

1. Field of the Invention

The present invention relates to building elements or members, but more particularly the present invention relates to a composite structural unit, its method of construction, and a method of constructing or assembling the individual units of the present invention so as to form structural arrays such as for example walls, columns, slabs, ceilings and the like.

2. General Background

It is known to form structural building arrays comprised of a plurality of individual units held together in load bearing abutment to one another by means of overall tension members which extend through or otherwise connect all the individual units in a dimension of the assembled structural array. The tension members are constituted generally of iron, steel or like tensile members with externally threaded ends (or like suitable connections) which extend to the ends of the assemblies of the units such as by the use of plates, washers and nuts, or like end bearing connections. The so constructed unit can be tightly drawn together and handled as a complete structural load bearing unit. Such units are useful in the in situ construction of walls, pre-fabrication of walls, floor slabs, arches, beam and column forms, and the like.

Among the advantages offered by such structural units is that there exists no necessity of using grout, mortar, or like conventional connections between the units or rows of units. Thus the structure can be formed with a smooth, dry load bearing joint at any place and transported from that place of assembly to the location of its use as a complete load bearing self contained unit.

Whereas structural units of this type have generally attempted to solve the problem of providing a structurally sound unit which can be assembled and transported, or in fact assembled at the job site without the use of grout, and attentive labor, a significant deficiency nonetheless exists in the use of such structure units.

One problem which arises with structural units which are so connected in the prior art, is that point stresses often develop at the joints or faces of the units where these members are in abutment, these stress points often being effected after construction when the applied load is manifested. The points of strain set up within the units often cause chipping, cracking, or in fact fracture or failure. Such flaws can at least create an unsightly appearance and worse can result in a threatened stability and utility of the structure itself.

A further problem seen with many prior art structural units is that they require a substantial amount of initial bracing and secondary support to the arrays or individual building units themselves during construction and prior to the application of the tension members to the structure. Such a need for secondary support is time consuming, labor wasting, and expensive. Oftentimes, without the use of heavy construction equipment and construction crews, this type of secondary structural support is out of the question.

Some other prior art units are restricted to a single structural array by their very nature, and cannot be combined into several different forms as may be desired by the individual who is constructing a specific planned building.

It is accordingly an object of the present invention to provide a new and novel structural building unit wherein a structural core to the building unit is provided, having load-distributing surfaces thereon to which point stresses can be applied without significant damage.

Another object of the present invention is to provide a structural building unit which is particularly useful in structural concrete applications, such as reinforced concrete, poststressed concrete, concrete shells, and architectural applications.

A further object of the present invention is to provide a means to more evenly distribute the load stress to the joints of abutting individual structural members without the problem of fracture or cracking.

A further and more specific object of the present invention is to provide structural building units of such character which do not require the use of mortar to hold the units together and which have particular utility in the construction on site or offsite of structural arrays formed from a plurality of individual structural units such as concrete walls, floor slabs, arches, beams, columns, and the like.

A further object of the present invention is to provide a composite structural unit which is provided with means for attaching it to other like units in order to form an array, with the connection means therebetween being the only structural connection necessary in order to form a final and complete structural bond with the individual unit to the array to which it is being attached during construction itself—secondary structures and bracing being unnecessary.

Another object of the present invention is to provide a method of construction of a composite structural unit, which constructed unit requires no additional milling, filing or like refinement after its casting.

These objects and others are achieved in accordance with the present invention embodying an apparatus, or structural building unit, comprised of a inner structural material and there being provided thereon outer load-distributing surfaces to which connection means can be attached without the problem of point stresses creating cracks, chips, or the like.

3. Prior Art

The prior art discloses a number of patents which have been issued on various building systems which attempt to provide a final array of individual building units in order to form walls, ceilings, slabs and the like. A listing of some prior art systems which have been patented is listed in the following table.

| Prior Art Patents | | |
|---|---|---|
| U.S. Pat. No. | Inventor(s) | Issue Date |
| Re. 27,785 | H. Kobayashi | Oct. 16, 1973 |
| 2,102,447 | D. D. Whitacre | Dec. 14, 1937 |
| 2,684,589 | A. Perreton | July 27, 1954 |
| 2,929,236 | H. W. Steward et al | Mar. 22, 1960 |
| 3,145,502 | D. Rubenstein | Aug. 25, 1964 |
| 3,173,226 | A. Solnick | Mar. 16, 1965 |
| 3,260,025 | C. Van Der Lely | July 12, 1966 |
| 3,378,969 | G. K. Larger | Apr. 23, 1968 |

Many of the devices or systems of the prior art which have been patented provide various drawbacks in their attempt to solve the aforementioned problems, to which problems the present invention is directed and which drawbacks and problems are solved by the present invention over the prior art.

U.S. Pat. No. 2,102,447 by Donald D. Whitacre provides a structural building system wherein there is the necessity to grind the contact surfaces between individual structural units prior to assembly. The present invention does not require the grinding or milling of the surfaces of the individual structural units prior to their use, but rather provides a method of construction by which the contact surfaces of the individual units are by their nature perfectly flat and aligned as is required before their use in forming an array.

The present invention provides a significant advantage over the prior art in that there is no necessity of the use of secondary structures or supplemental structures in order to support the array prior to the application of the tensioning members thereto. In the method of constructing the arrays of the present invention, the tension is applied with the addition of each structural unit and such tension member holds that individual structural unit in place without the use of secondary structures, secondary bars, or secondary supports in order to hold the unit until the entire structural unit can be tensioned. The Kobayashi patent, U.S. Pat. No. Re. 27,785 provides the use of such a supplemental structure until the concrete hardens. Such a device requires a secondary structure until the curing time of concrete gives it the desired strength.

U.S. Pat. No. 3,173,226 issued to Abraham Solnick requires the use of extra supportive framework.

In contrast to U.S. Pat. No. 3,145,502 issued to D. Rubenstein, in the present case of plates or surfaces made of plastic, the surface, if formed after the initial molding, is on the abutting surfaces not on the facing surfaces as in the Rubenstein patent.

The present invention does not require a complex system of rods which can only be stressed after an entire row of units is laid, such as is taught in the Perreton patent, U.S. Pat. No. 2,684,589.

U.S. Pat. No. 3,260,025, issued to C. Van Der Lely discloses the use of facings which are formed of a plastic material to make a seal. In the '025 patent, the object is to seal, not to distribute the load evenly over the contact surface as is the case with the present invention. The object of the present invention is to distribute the load and hence the facing material has different characteristics.

The rods with the present invention are not made continuous throughout the entire span as in the devices of the prior art, and do not transmit unequal loads with expansion and contraction effects of rods throughout a dimension of the entire structure.

Also a specific object is to provide a method of assembling the units whereby one unit is placed in position and means of applying compressive force to keep it in place is applied to that unit suitably by the application of tension to rods one end of which is anchored on a face of a unit already in place, that face being other than the one abutting the unit just positioned and the other end of the rod being attached to a face of the unit just positioned which is not identical to the abutting face of the unit just positioned.

DISCUSSION OF THE PRESENT INVENTION

Thus the present invention provides a structural unit construction which has inner structural load carrying capability, with an outer load-distributing surface which distributes the compressive load generated at the abutting surfaces of the individual structural units over a wider area, and transmits the loads through the interface formed between the facing of the structural unit and the face of the core material which forms the body of the structural unit, which is by the method of formation of the composite devoid of imperfections in mating interface which lead to point stresses.

By the use of hard or metal contact facings, the force is transferred from the core inner surface of the material which forms the structural unit to the metal surface of the contact plate which it must of necessity exactly match since the surface of the body of the structural unit was formed in contact with the facing. The force is then transferred from one outer metal surface to the outer surface of the metal or otherwise constituted facing of the abutting structural unit and then through the facing to the outer facing of the core body of the next structural unit. If there is unevenness of contact at the metal to metal interface the internal strength of the facing (metal) absorbs these stresses and distributes the force more evenly over the face of the core body. This ability of the facing becomes more and more important with the increase in compressive loads encountered with high tension in the tension rods and with greater height if the structural units are placed one atop the other as in the construction of columns or walls.

The present invention can be manufactured using structural units with clay as well as cement and like structurally sound materials, with the facings being manufactured of a suitable load-distributing material such as plastic, metal, and the like. The present invention provides such an individual structural unit which can be bound in face-to-face relationships in order to form constructive arrays. The units are self supported upon attachment using a suitable tension means such as an elongated metal rod, or a plurality thereof, preferably constituted of iron, steel, or like tensile material which is passed through a plurality of openings or perforations through the units themselves. The end portions of the rods can be externally threaded and adapted for threadable engagement with a plate, nut, or the like; however, any suitable means of connecting units together by affixing the end portions of the rod can be used.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
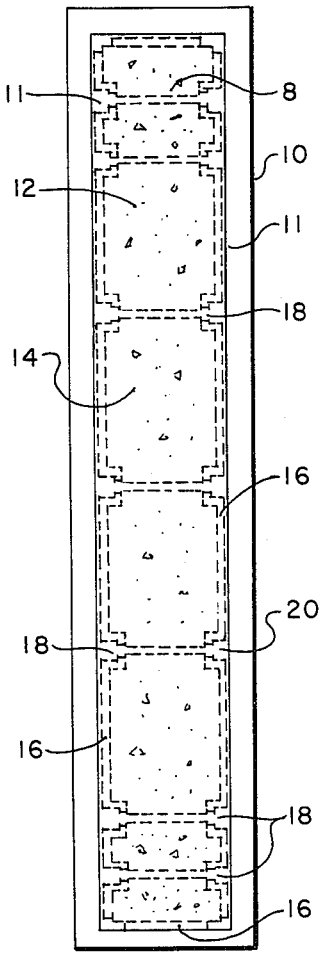
FIG. 1 depicts a top plan view of a mold used in the method of construction of the preferred embodiment of the composite unit apparatus of the present invention—the composite unit shown therein in phantom lines.

FIG. 1 illustrates a preferred embodiment of the mold 10 of the present invention which can be used to manufacture units 12 in accordance with the teaching of the present invention. As can best be seen by an inspection of FIG. 1, there is provided a shaped mold 10 having inner walls defining a shape corresponding to the desired shape of the individual unit 12 to be formed.

In FIG. 1, there is shown in phantom lines composite unit 12 which is comprised generally of an inner structural material 14 and outer load-distributing surfaces in the form of plates 16.

As can be seen in FIG. 1, in order to construct composite unit 12, outer load-distributing plates 16 are first placed in a desired position along the inner walls 11 of mold 10 such that when a suitable flowable material such as concrete, plastic, clay or the like is added to form inner core 14, it will exactly conform to the space provided between the load-distributing plates 16. If the mold 10 is properly constructed, inner walls 11 will act as a "jig" which will exactly position load-distributing plates 16 so that their outer surfaces 17 will not require additional filing or milling before use. The surfaces will easily fit together in face-to-face relationship, being compatible when several units 12 are combined to form an array. The connection or adhesion of plates 16 to unit 12 can be augmented using projections (not shown) attached to plate 16 which would act as anchors when inner core 14 "sets". Any suitable chemical bonding agent could likewise be used to augment the adhesion of the load-distributing plates to the structural core. Inded, it is also possible, though time consuming to apply the load-distributing plates after the structural core material has "set" if the chemical bonding agent has the ability to withstand the compressive loads and, like the structural core material, at some point during or following its application, flows to conform to the surfaces which it bonds, thus again not forming point stresses.

A further inspection of FIG. 1 will reveal the presence of a plurality of bores 18 which are provided through the center portion of unit 12. These bores 18 form openings through which tension means (which can be in the form of elongated metal rods) can pass so as to eventually fasten a plurality of units 12 together. There is further provided as is shown in FIG. 1, a recess 20 on the opposite ends of each bore 18 which provides an enlarged area to facilitate the location of a suitable fastener such as a bolt, or the like.

Figure 3:
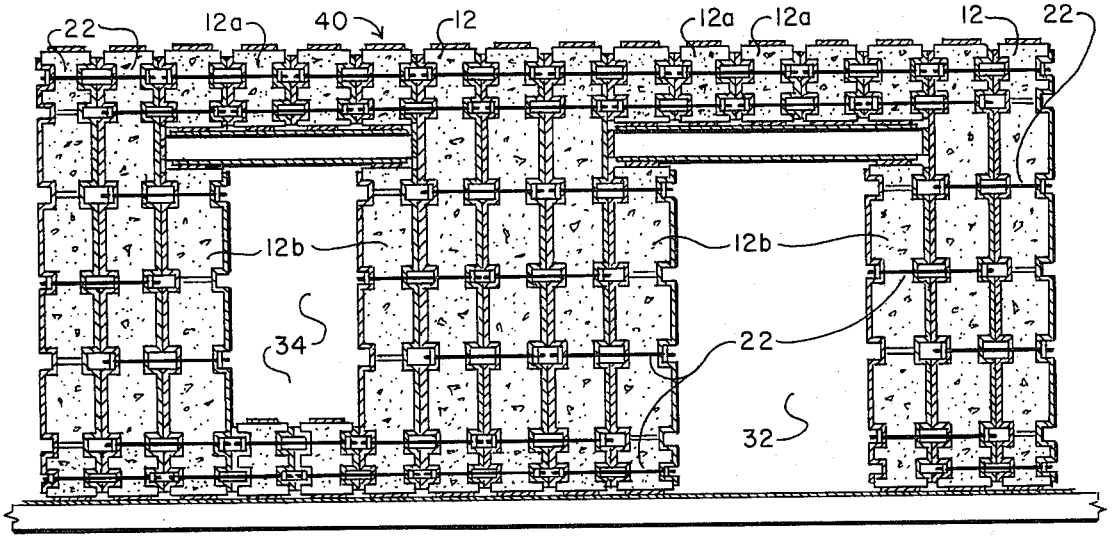
FIG. 3 is an elevational view of various sizes of composite units of the first embodiment of the present invention.
Figure 2:
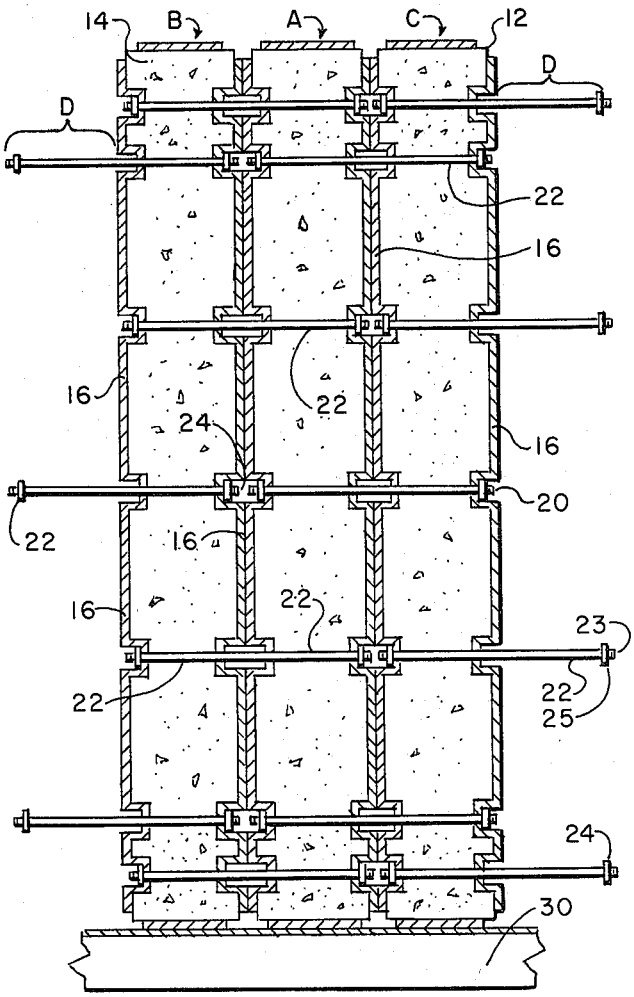
FIG. 2 depicts a composite structural building array formed from a plurality of units of a first embodiment of the present invention, the array being characterized of one modular unit which constitutes the building described by reference to FIG. 3.

FIGS. 2 and 3 illustrate the use of completed composite units 12 to form a structural array such as a wall or the like. In FIG. 2, there can be seen three units 12 as is shown during their construction in FIG. 1. The completed units 12, it will be noted from FIG. 2, do not require any additional milling, planing, or surface treatment, in order that they may mate together in a perfect fit upon assembly. In FIG. 2, units 12 can be seen each having load bearing plates 16 on their load bearing surfaces. The inner core 14 is shown having been cast and hardened into the proper position as was illustrated in FIG. 1 with mold 10. Now, the inner core 14 is suitably hardened and has desirable compressive strength characteristics which of course are designed after considering the desired load carrying characteristics of the structure being built.

In FIG. 2, there is seen a plurality of tension members which are in the form of connecting rods 22. In FIG. 2, each connecting rod 22 can be an elongated rod of a material such as steel, iron, or like suitable tensile material. Rods 22 can be threaded being provided with threads 23 at their respective end portions as is known in the art. There can further be provided bolts 24 which threadably engage and attach to connecting rods 22 at threads 23. If desirable, washers 25 can be provided which are placed between bolt 24 and load bearing plates 16. It will be seen, that when connecting rod 22 is in its proper position, connecting together any two of units 12, bolts 24 will assume a flush position within recess 20 thereby not interfering with the addition of other units as the construction continues. The connection can be completed with a desired tension or stress to rod 22 by use of a connectional torque wrench to guarantee uniformity and consistency throughout the structure.

When constructing the device in this manner, it can be seen that by beginning with a single unit (designated as unit "A" in FIG. 2) it is easy to add additional units (such as "B" and "C" in FIG. 2) without any additional structural support other than rods 22. Thus, if one began by placement of unit A resting against a base slab 30 as is shown in FIG. 2, unit B could be added and attached thereto permanently and structurally by connecting rods 22 as is shown. In FIG. 2, every other bore 18 in unit 12 is provided with a rod 22 to connect units A and B together. Note, however, that in the alternate openings 18 the connecting rods 22 are connected only to unit B and project outwardly therefrom a distance which will allow the addition of a further unit when it is added after A and B are secured together. Such an arrangement is important, because each unit is completely affixed to the structural array upon bolting, but additional units 12 can always be added if desired. It is also important that the aligned tensile rods are not connected one to the other because unequal stresses are created within the array decreasing its strength.

In a like manner, there can be seen at the connection between units A and C, the use of every other or alternating connecting rods 22 in order to form the structural connection between A and C, with the alternate or other rods 22 being connected to C only and projecting a distance out therefrom in order to add another composite unit. The projection distance of the rods which will be used to add additional units 12 is designated by the letter D in FIG. 2.

Alternatively, the rods 22 need not be placed within unit C so that they project a distance D for the attachment of additional units 12, not shown. Instead, the additional unit 12, not shown, may be placed in abutment with unit C and then the rods 16 which attach it to unit C may be inserted through holes 18 and by suitable means anchored or attached at one end to the facing 16 of unit C which contacts facing 16 of unit A and attached at the other end to the vertical facing 16 of the unit 12, not shown, which is not in contact with a facing 16 of unit C.

FIG. 3 illustrates a structural array which can be for example a wall, and is designated generally by the numeral 40 in FIG. 3. There it can be seen that array 40 is constructed of a plurality of individual units 12, each being attached by means of a plurality of connecting rods 22 which can be threadably mounted (or like suitable connection) to the units as was described more fully above. Note in FIG. 2 that each alternating rod 22 is "staggered" so that there will always be a projecting amount of rod 22 beyond the surface of the previously connected unit so that additional units 12 can be added as needed. In FIG. 3, it can be seen that units 12 can be of varying dimensions within the teaching of this invention. Note smaller units 12*a* as they appear above door 32 and window 34 in FIG. 3. Likewise, units 12*b* are of a shorter dimension than units 12 which are substantially the height of array 40 which forms a wall in FIG. 3.

With the method of construction as described more fully above, it should be appreciated that there is no necessity for extra bracing or like supplemental support in order to apply the tensioning members 22 and connect additional units 12 to the array. To the contrary, each unit 12 when added to the structure and fastened into place using connections 22 is totally and completely structurally sound with the array 40 as a whole anf forms its structural part thereof without necessity of grout, concrete, supplemental supports, or the like, thus offering a significant economic advantage over the prior art with a significantly decreased possibility of the creation of point stresses found in the prior art in a more economic manner than in the prior art.

However, grout or mortar may be injected into the void area of the bores 18 between the rods and the wall of the bore to give an additional measure of strength if desired as is known in the art. However, such is not necessary and renders the structure more permanent.

Thus, it can be seen that utilizing the apparatus and method of construction of the present invention there can be constructed an array 40 of units 12 to form a wall simply by use of connecting rods 22 within the teaching of the present invention.

Figure 5:
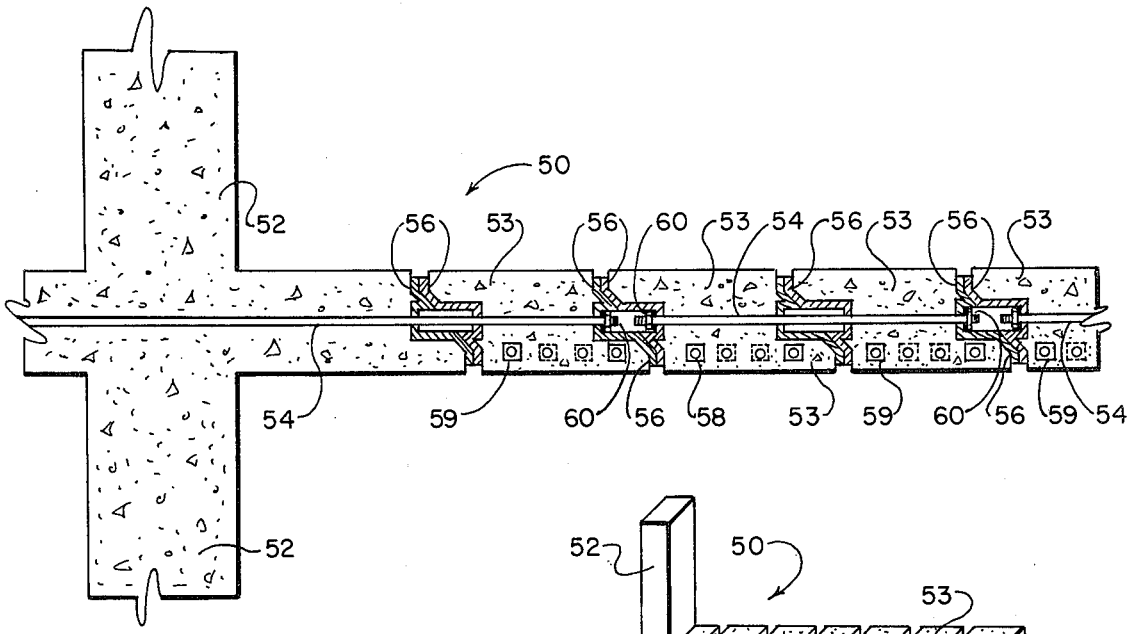
FIG. 5 depicts a cross sectional view taken along lines 5—5 of FIG. 4.
Figure 4:
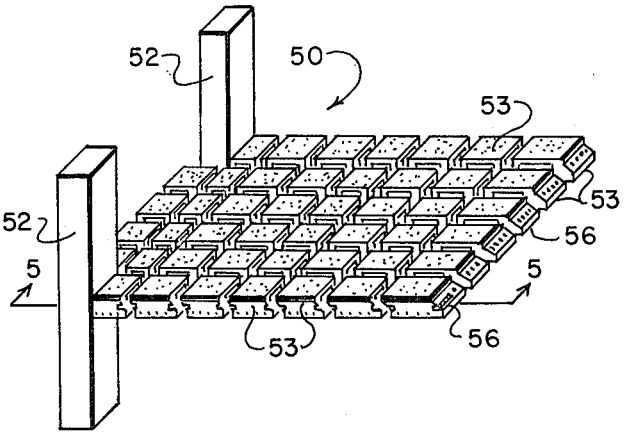
FIG. 4 is a perspective view of a slab section formed from an assembly of the second embodiment of the composite unit structure of the present invention held together by suitable tensioning means.

FIGS. 4 and 5 illustrate a second embodiment of the apparatus of the present invention. In FIG. 5, there can be seen a slab 50 constructed between columns 52. Slab 50 can be constructed of a plurality of units 53 using connecting rods 54. Units 54 in the second embodiment have generally diagonal load-distributing plates 56 which aid in the structural integrity of slab 50 which is subjected to high shearing forces as is apparent to one skilled in the art.

The use of diagonal plates 56 illustrates but a second embodiment of the teaching of the present invention, though the method of constructing units 53 would be by use of a mold 10 as was described more fully above and with reference to FIG. 1. The mold 10 used to cast units 53 would provide inner walls 11 which would create a "jig" effect to orient bearing plates 56 into a desired spaced relationship so that no additional milling, cutting, or forming of plates 56 would be required when the casting was completed. Openings would be provided through structural units 53 in the same manner as they were provided in the first embodiment discussed above so that connecting rods 54 could be "staggered" enabling the assembly of slab 50 without the necessity of extra structural supports, external bracing, grout, concrete, or the like. There is seen in FIG. 5 a plurality of openings 58 through which tensile connectors could pass in a direction traverse to the rods 54 shown in FIG. 5. Such traverse openings 58 would provide connection to slab 50 in a direction normal to the connection rods 54 shown in FIG. 5 so that the slab 50 could br braced in both directions as would be desirable. Note that in FIG. 5 there is shown recesses 59, 59′ which allow a space into which bolts 60 or like connections can be placed so as not to interfere with the interface between successive structural units 53.

Figure 6:
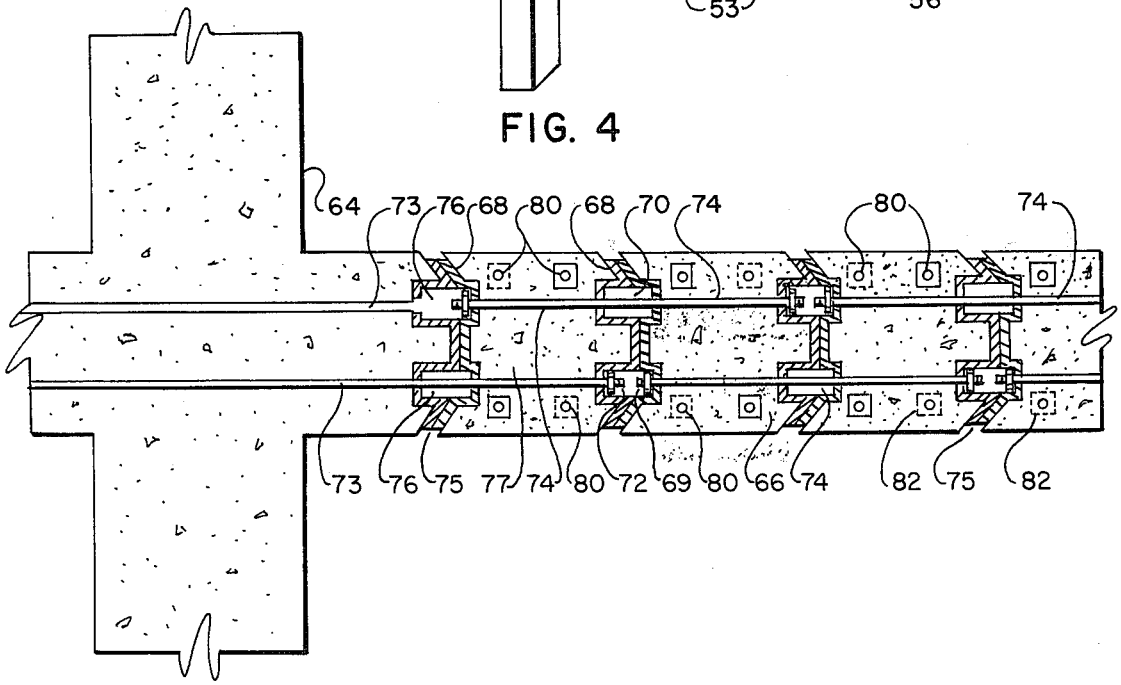
FIG. 6 is a cross sectional view of a typical slab formation using the third embodiment of the composite unit structure of the present invention.
Figure 10:
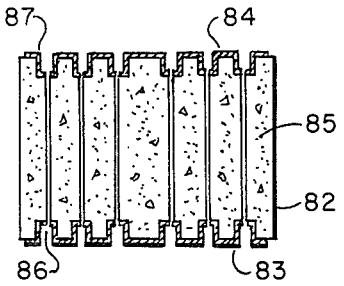
FIG. 10 is a side elevational view and partial section of a single isolated unit of the fourth embodiment of the composite unit structure of the present invention as employed in the structural array depicted by reference to FIGS. 7 and 8.

FIG. 6 illustrates a third embodiment of the composite structural unit of the present invention. The embodiment shown in FIG. 6 provides a slab structure designated generally as 62 attached to column 64 which utilizes a plurality of structural units 66 which are constructed within the teaching of the present invention using a suitable mold 10 giving the desired structural unit geometry. Units 66 provide diagonal load-distributing plates 68, each plate provided with a pair of recesses 69, 70 which can be used for the placement of a bolt 72 or like connective member at the end of a tension rod 74 as shown in the drawings. In FIG. 6, it can be seen that there is likewise provided a second cooperative bearing plate 75 which abuts and fits comfortably against plate 68 so as to form a mate therewith. Likewise, bearing plate 75 is provided with recesses 76 for the accompanyment of bolt heads 72 or like connectors. In the embodiment shown in FIG. 6, there can be provided two connective rods 74 in separate horizontal layers as is illustrated in the drawing. In the embodiment shown in FIG. 6, connective rods 74 could be of any high tensile material such as steel or the like, and the inner core 77 of units 66 could be formed of concrete for example. There is likewise provided openings 80 traverse to that direction of rods 74 in FIG. 6. Openings 80 and corresponding recesses 82 could be used to accompany rods 74 and bolts 72 respectively within the teaching of the present invention.

In order to suitably anchor the first unit as added to column 64, there could be provided an initial anchor rod 73 as is shown in the drawing, with the length of rod 73 being "developed" by its embedment into the concrete column 64 a desired distance as is known in the art. In FIG. 6 there is an alternating arrangement of rods 74 in the plane of the drawing. However, it should be understood that the alternating arrangement, which allows subsequent units to be added to the array, may be in a direction normal to the rods 74 shown in FIG. 6, the same effect being achieved.

Figure 7:
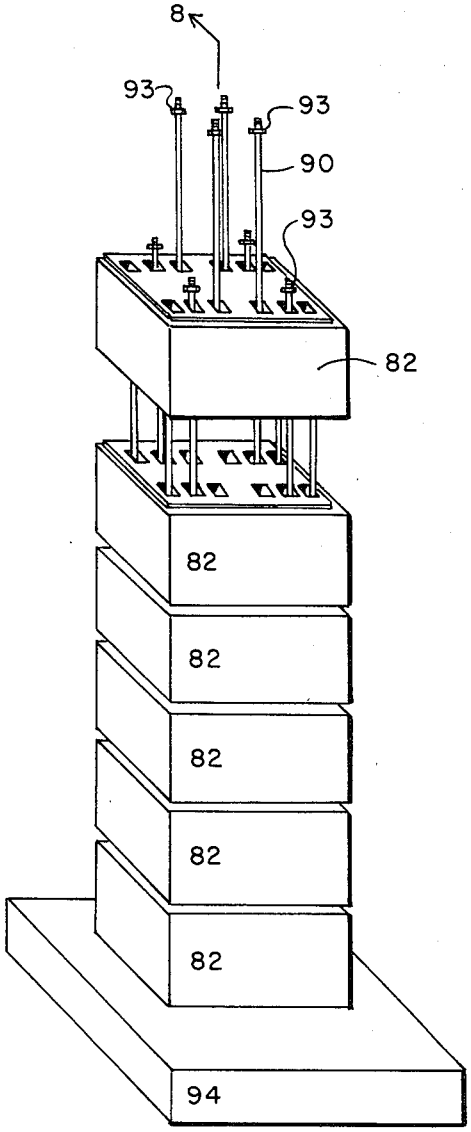
FIG. 7 is a perspective view illustrating a fourth embodiment of the composite unit structure of the present invention being attached to form a structural column.

FIGS. 7–10 illustrate a fourth embodiment of the composite structural unit of the present invention. There can be seen in FIGS. 7–10 a block 82 having load-distributing plates 83, 84, respectively, on its lower and upper portions as viewed in FIG. 10. Unit 82 would likewise be formed having an inner core 85 of a suitable material having the necessary compressive strength, and plates 83, 84 providing a surface which would have load-distributing characteristics necessary in order to transmit the compressive forces generated by connecting rods 90 to unit 82. In FIG. 7, there can be seen a column 92 constructed of a plurality of units 82. Column 92 would be merely a single array having individual units 82 "stacked" thereon as shown in the drawings. There would be provided a plurality of openings 86 through which connecting rods 90 could be placed as is shown best in FIGS. 7 and 8. Likewise, as with the previous embodiments of the present invention, there could be provided recesses 87 which would provide a space for bolts 93 which could be threadably connectable to the end portions of rods 90.

Figure 8:
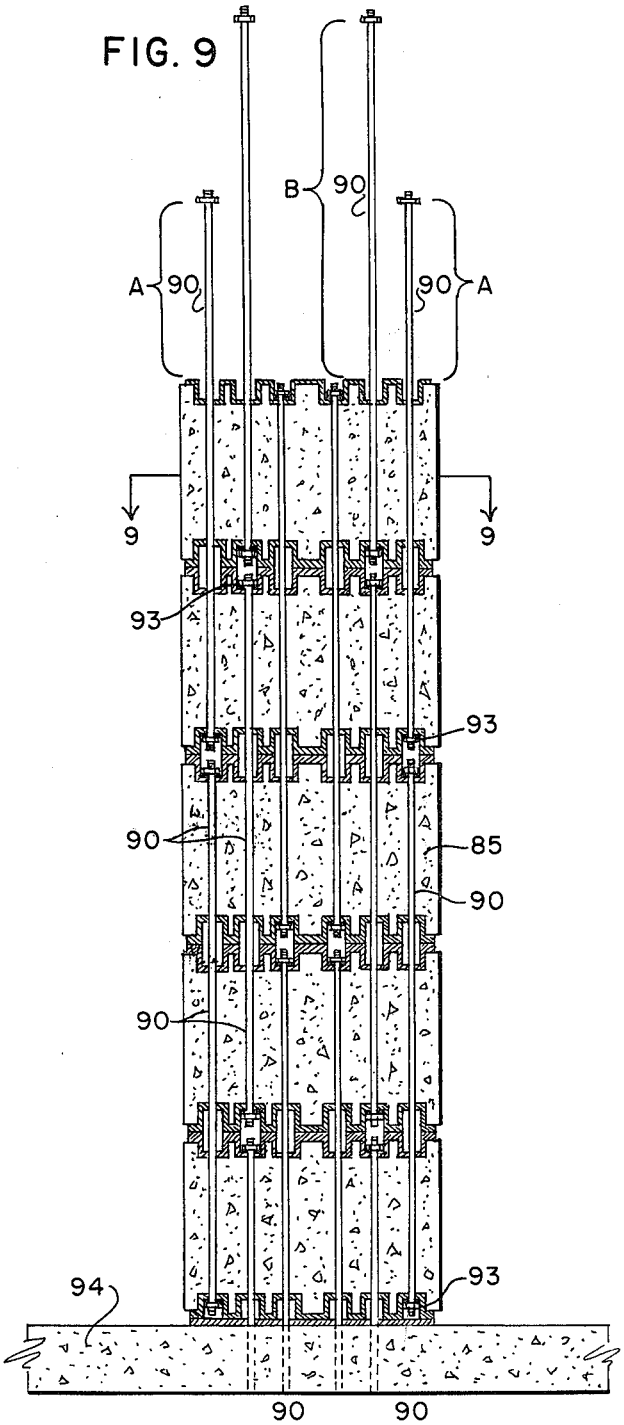
FIG. 8 is a sectional view taken along lines 8—8 of FIG. 7.

FIG. 8 helps illustrate the method of construction of the present invention to construct column 92 of FIG. 7. In FIG. 8 there is seen a base slab 94 which has embedded therein a plurality of connectors 90 so as to form a spot for "beginning" column 92. After the first structural unit is placed over the initial rods 90, successive units can be added by "staggering" the rods 90 so as to always provide an exposed portions "A" and "B" of rod 90 on units 82 as desired. It is within the teaching of the present invention that the pattern may be altered so that the individual rods 90 and the connecting rods of the other embodiment may be of sufficient length to pass through any number of structural units less than the number of structural units required for the entire eventual span creating a slightly different but basically similar interlocking pattern although FIG. 8 shows that number to be three. Note in FIG. 8 there are provided rods 90 which project a distance A above the uppermost unit 82. These rods 90 which project a distance A, would initially bolt or attach and hold the next unit added to the stack, whereas there is also provided rods 90 which project a second distance B above the last added unit shown in FIG. 8. When a second unit were to be added to the stack as shown in FIG. 8, the rods which project a distance B would be utilized to secure that particular unit into its position. Thus, there can be seen a method of construction shown with the column of FIGS. 7 and 8 which provides a connection of each successive unit to the column, with each connection forming a complete integral structural connection with the previous unit, there being no need for supplemental bracing, or other structural supports.

As in the first embodiment of the present invention and in all embodiments of the present invention the tensile rods 90 of FIGS. 7 and 8 need not project distances B and A, but may be inserted as required to attached successive structural units 82 to the columnar array 92 after placement of a structural unit in position on the columnar array.

Figure 9:
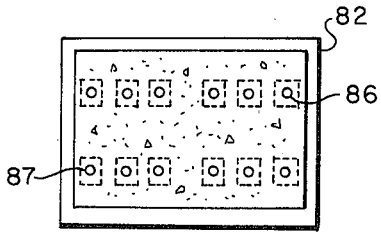
FIG. 9 is a sectional view taken along lines 9—9 of FIG. 8.

FIG. 9 illustrates a top view of the column shown in FIG. 8, whereby it can be seen a plurality of openings 86 through which rods 90 can pass, and there can also be seen recesses 87.

Figure 11:
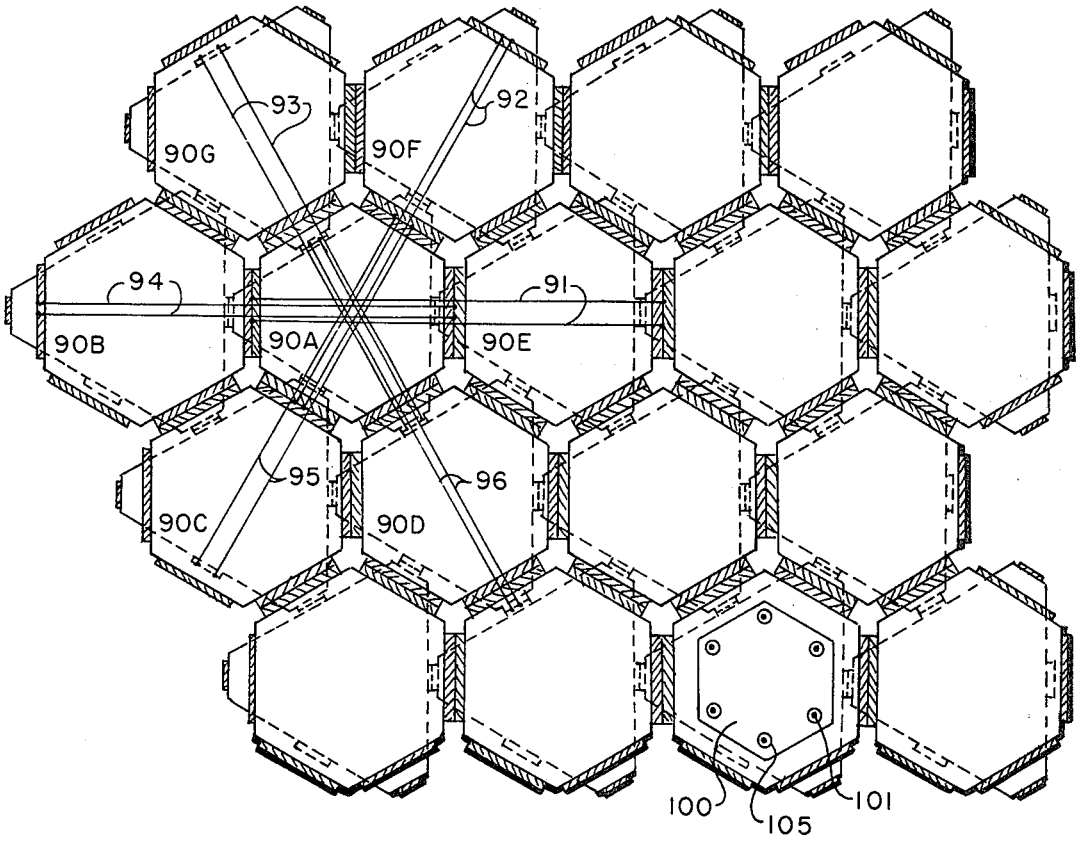
FIG. 11 depicts in plan a slab formed by members of a fifth alternative embodiment of the unit of the present invention.
Figure 12:
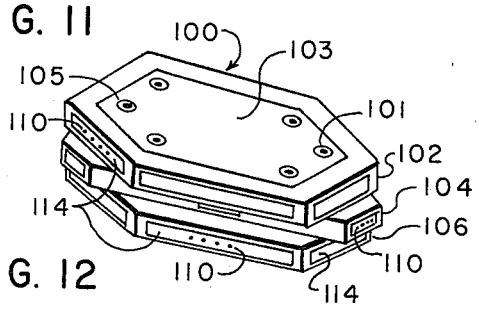
FIG. 12 is a perspective view of a single unit of the alternative embodiment of the apparatus of the present invention as forms of the structure depicted by reference to FIG. 11.
Figure 13:
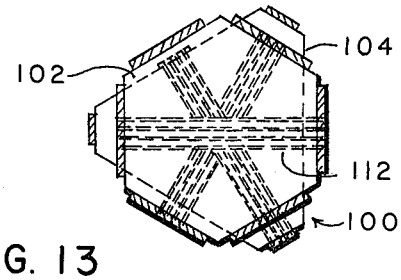
FIG. 13 is a top sectional view of the unit of FIGS. 11 and 12.

FIGS. 11 through 13 illustrate a fifth embodiment of the apparatus of the present invention. In FIG. 12, hexagonal unit 100 is made to appear as a plurality of stacked solid layers 102, 104 and 106. It should be understood, however, that the exemplary number of three (3) layers provided to unit 100 as shown in FIG. 11 is not absolute. Each layer represents generally a line of force through which connections can be made through various abutting units so as to form an array as shown in FIG. 12, thus varying numbers of layers 102, 104, 106 could be provided.

In FIG. 12, there can be seen connection holes 110 through which suitable connecting rods (not shown) can be attached. Bearing plates 114 are provided at the outer edges of each layer 102, 104, 106 as is the case with previous units within the teaching of the present invention as was described more fully heretofore. The units 100 can be connected to form an array as shown in FIG. 11, with the rods 112 being alternatively arranged so that each unit 100 can be securely connected to the preceding unit 100 or to the array in the manner as depicted for the single structural unit 90A in FIG. 11. In FIG. 11, unit 90A is connected at its edges to units 90B, 90C, 90D, 90E, 90F and 90G. Tensile connectors 91, 92, 93, 94, 95 and 96 secure the array as is shown in FIG. 11. Thus an interlocking repeating pattern is formed. In FIG. 12, there is shown attached to the individual hexagonal structural unit 100 a load-distributing plate 103 with holes 101 passing through it and the structural core of the unit 100 with recesses 105 which allow the usage of the structural unit at the same time as both an element in a vertical array of a column, similar to the fourth embodiment of the invention described in conjunction with FIGS. 7 through 9, and an element in the horizontal two-dimensional array of a slab. Thus, the horizontal two-dimensional array of the slab and the one dimensional array of a column are integrally connected.

The structural units 100 can be formed much in the same way as the previous teachings of this application, in which a mold 10 is utilized having geometrically desirably arranged inner walls 11 to which walls there can be affixed bearing plates 114 prior to the addition of a desired flowable "setting" material. When the setting material hardens (for example in 28 days or so with concrete), the mold can be removed and the unit is ready for its operational use in a structural array or the like.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A composite unit, for building structural arrays, comprising more than one individual module wherein each individual module is composed of:

a. an inner structural core of a first material;

b. a plurality of load-distributing elements attached to portions of the surface of said core, each of said elements being of a second material different from said first material and being substantially hard to resist fracture, there being provided a plurality of holes through said inner core and said attached elements, said elements providing a mating face for contacting the face of an adjacent attached module, wherein the mating face of the said adjacent attached module is also provided with at least one of said elements;

c. elongated tension means for holding at least two of the modules tightly together in face-to-face relationship forming a composite unit when said holes through said inner core and said attached elements are substantially aligned defining a bore through which said tension means is connectable.

2. The unit of claim 1, wherein said core is a setting material, being initially fluid but later setting to provide a rigid structural form.

3. The unit of claim 1 wherein said tension means is a rod inserted through said bores, there being further provided on said rod tension adjustment means for applying tension to said rod when said rod is affixing two of said units together.

4. The apparatus of claim 3, wherein there is provided a recess at the surface of said element at each of said holes, said recess providing a space for said tension adjustment means on said rod.

5. The apparatus of claim 3 wherein said rod is at least partially threaded at its end portions, and said tension adjustment means is a nut threadably mounted on said rod.

6. The unit of claim 3 wherein each of said load-distributing elements comprises a plate structure, said plate structure integrally cast to a surface of said inner structural core, said plate being provided with a plurality of recesses therein, each of said recesses providing an annular bore, with an opening in the lower portion of said bore and said rod is at least partially threaded at its end portions, and said tension adjustment means is a nut threadably mounted on said rod, said bore of a recess for placement of said nut, when said rod is applied to said bore and the hole in said inner core.

7. The unit of claim 6 wherein a plurality of said units are connected using said tension means to form a slab.

8. The unit of claim 6 wherein a plurality of said units are connected using said tension means to form a column.

9. The unit of claim 6 wherein a plurality of said units are connecting using said tension means to form a wall.

* * * * *